US012611019B2

(12) United States Patent
Kaminski

(10) Patent No.: US 12,611,019 B2
(45) Date of Patent: Apr. 28, 2026

(54) CURLING IRON AND METHOD FOR CURLING HAIR

(71) Applicant: Mia Kaminski, Franklin, IN (US)

(72) Inventor: Mia Kaminski, Franklin, IN (US)

( * ) Notice: Subject to any disclaimer, the term of this patent is extended or adjusted under 35 U.S.C. 154(b) by 575 days.

(21) Appl. No.: 18/148,970

(22) Filed: Dec. 30, 2022

(65) Prior Publication Data

US 2023/0143505 A1 May 11, 2023

Related U.S. Application Data

(63) Continuation-in-part of application No. 29/753,278, filed on Sep. 30, 2020, now Pat. No. Des. 979,133.

(51) Int. Cl.
*A45D 1/16* (2006.01)

(52) U.S. Cl.
CPC ..... *A45D 1/16* (2013.01)

(58) Field of Classification Search
CPC ... A45D 1/04; A45D 1/10; A45D 1/14; A45D 1/16; A45D 1/28; A45D 2001/002; A45D 2001/004; A45D 2001/006; A45D 2/00; A45D 2/001; A45D 2/367; A45D 20/48; A45D 6/02; A45D 6/04
USPC ..... D28/10, 35, 38
See application file for complete search history.

(56) References Cited

U.S. PATENT DOCUMENTS 599,956 A 3/1898 Hiram
3,955,064 A * 5/1976 Demetrio ..... H05B 3/06 219/541
D257,541 S 11/1980 Fox et al.
5,046,516 A * 9/1991 Barradas ..... A45D 1/04 219/222
D342,998 S 1/1994 Krug et al.
D348,954 S 7/1994 Magone et al.
D358,682 S 5/1995 Johnson
D389,716 S 1/1998 Cohen et al.
5,899,210 A 5/1999 Letherby et al.
D475,808 S * 6/2003 Jancik ..... D28/59
D651,343 S * 12/2011 Robson ..... D28/35
D656,808 S 4/2012 Arvinte et al.
D672,500 S * 12/2012 Kim ..... D28/35
D779,728 S * 2/2017 Bermudez ..... D28/35
(Continued)

FOREIGN PATENT DOCUMENTS

CN 2020300975385 A 8/2020
CN 202130853446 A 4/2022

OTHER PUBLICATIONS

4 Stage Nail Buffer, Published on: Feb. 7, 2018 (online), Retrieved on: Jan. 8, 2024 (online), https://www.amazon.co.uk/Stage/Nail-Buffer-Smooth-Shine/dp/BO79NC7R9L (Year: 2018).
(Continued)

*Primary Examiner* — Rachel R Steitz
*Assistant Examiner* — Karim Asqiriba
(74) *Attorney, Agent, or Firm* — Patterson Intellectual Property Law; S. Chase Talbot

(57) ABSTRACT

Disclosed herein is a hair curling iron. The hair curling iron of the present invention includes an iron body. The iron body has a heating body having a tapered triangular shape with a triangular cross-section, and a handle which is coupled to an end of the heating body. In the current invention, the triangular heating body provides new types of hair curls as a result of the tapered triangular shape.

1 Claim, 6 Drawing Sheets

(56) References Cited

U.S. PATENT DOCUMENTS

| | | | | |
|---|---|---|---|---|
| D861,248 | S | 9/2019 | Barbaglia et al. | |
| D887,634 | S | 6/2020 | Ashley | |
| D929,239 | S | 8/2021 | Caiaffa | |
| D935,612 | S | 11/2021 | Levy | |
| D940,959 | S | 1/2022 | Scott et al. | |
| D948,165 | S | 4/2022 | Alston | |
| D966,612 | S | 10/2022 | Tang | |
| D972,136 | S | 12/2022 | Levy | |
| D989,959 | S | 6/2023 | Levy | |
| D990,046 | S | 6/2023 | Levy | |
| 2005/0081870 | A1 | 4/2005 | Jancik | |
| 2011/0132391 | A1* | 6/2011 | Cheung | A45D 1/04 83/13 |
| 2011/0232673 | A1* | 9/2011 | Crawford | A45D 1/04 132/232 |
| 2016/0271646 | A1* | 9/2016 | deGrood | A45D 27/00 |
| 2023/0143505 | A1 | 5/2023 | Kaminski | |

OTHER PUBLICATIONS

Beavorty 12 Pcs Hexagon Nail File Buffer Block, Published on: May 1, 2023 (online), Retrieved on: Jan. 8, 2024 (online), https://www.amazon.com/Beavorty-Portable-Manicure-Professional-Pedicure/dp/BOC42GFWJX (Year: 2023).

* cited by examiner

CURLING IRON AND METHOD FOR CURLING HAIR

This Patent application claims priority to U.S. Provisional Patent Application No. 29/753,278 filed on Sep. 30, 2020, which is incorporated by reference herein, in its entirety.

BACKGROUND OF THE INVENTION

The present invention relates to electric curling irons for hair, and more particularly to an electric curling iron with a triangular shape.

This relates to hair curling irons, which have been a staple of women's hair styling products for years. Heated hair may be smoothed, manipulated, and styled more easily that non-heated hair. In general, curling irons impart a curl or pattern to hair being styled by sufficiently heating a barrel or mandrel of the curling iron and restraining the hair in physical contact with the barrel to thermally heat the hair. A section of hair is typically wound around the heated barrel of the curling iron and held in contact with the heated barrel for a period of time. Heat from the heated barrel reforms plastic bonds in the hair. When the heat styled hair is removed from the heated barrel the hair retains the shape of the curling iron's barrel.

The radius of the curling iron barrel has a significant effect on the curling properties of the curling iron. A barrel that has a relatively small radius results in a tighter and longer lasting curl whereas a barrel that has a relatively large radius forms a looser curl (i.e., a more open curl or wave pattern) in hair being styled. Curling irons having a relatively large radius barrel may be used to iron (i.e., straighten) sections of hair.

Typically curling irons use a cylindrical iron body which contains a heating element, allowing the hair to be curled. As such, there is a need for curling irons with differently shaped barrels for different hairstyles.

SUMMARY OF THE INVENTION

The present apparatus is a hair curling iron with a tapered triangular shape. The hair curling iron of the present invention includes an iron body which is heated. The iron body has a heating body having a tapered triangular shape with a triangular cross-section, and a handle which is coupled to an end of the heating body. In the current invention, the triangular heating body provides new types of hair curls as a result of the tapered triangular shape.

DETAILED DESCRIPTION OF THE INVENTION

Figure 1:
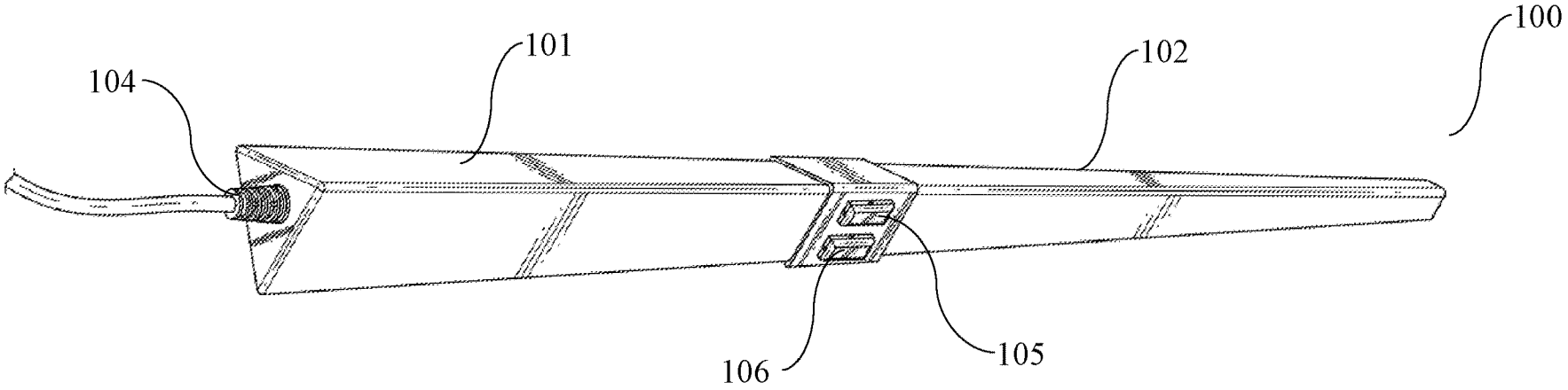
FIG. 1 is a front elevational view of an embodiment of the invention.
Figure 2:
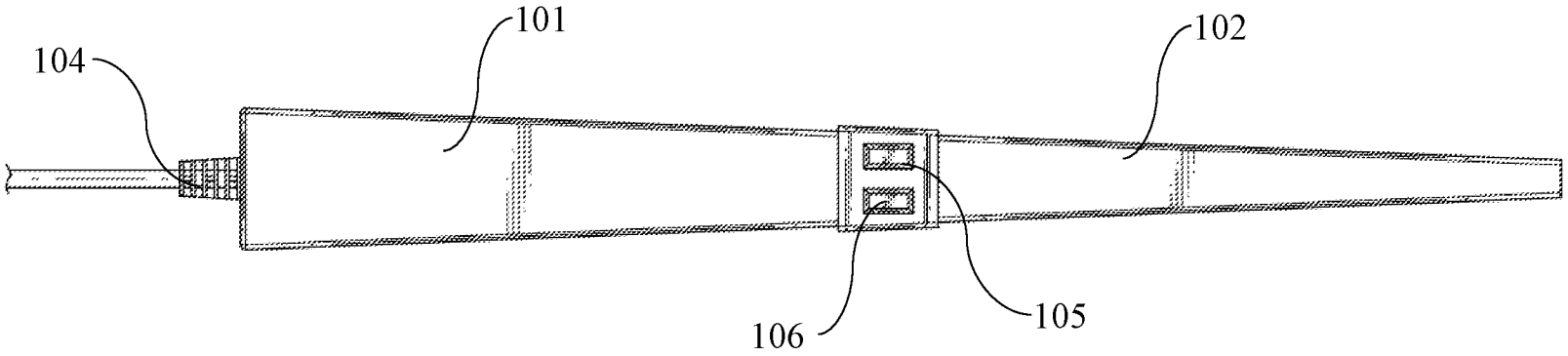
FIG. 2 is a front plan view thereof.
Figure 3:
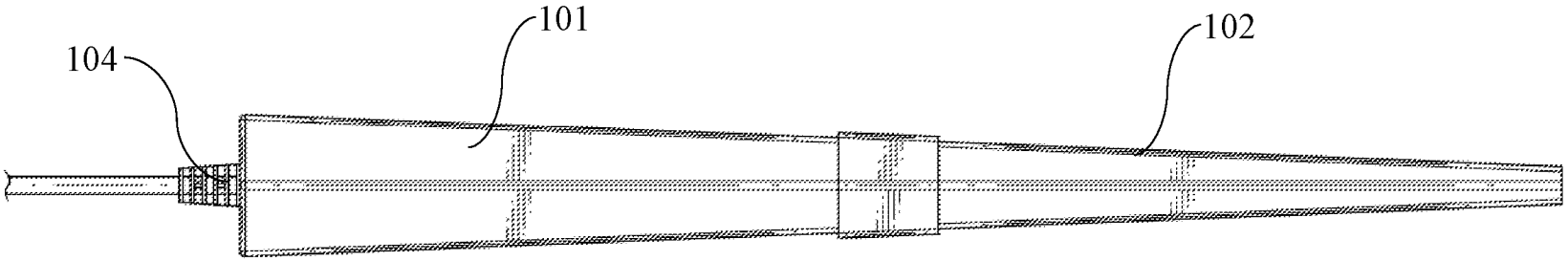
FIG. 3 is a bottom plan view thereof.
Figure 4:
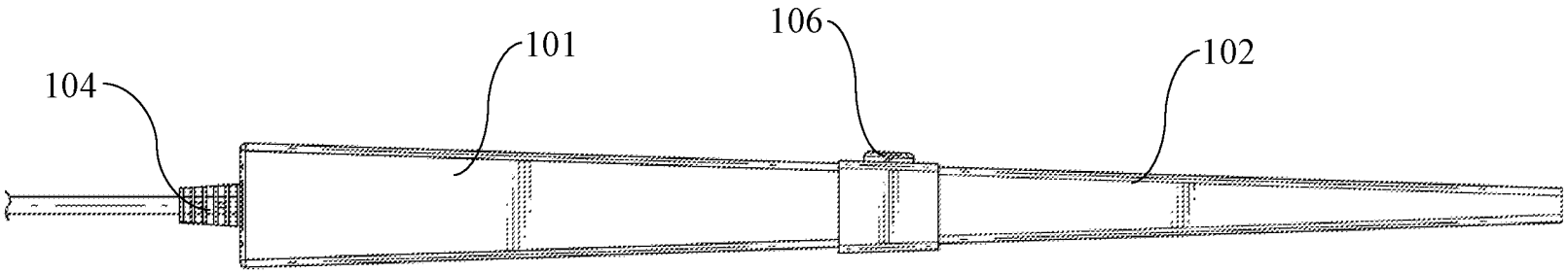
FIG. 4 is a right-side elevational view thereof.
Figure 5:
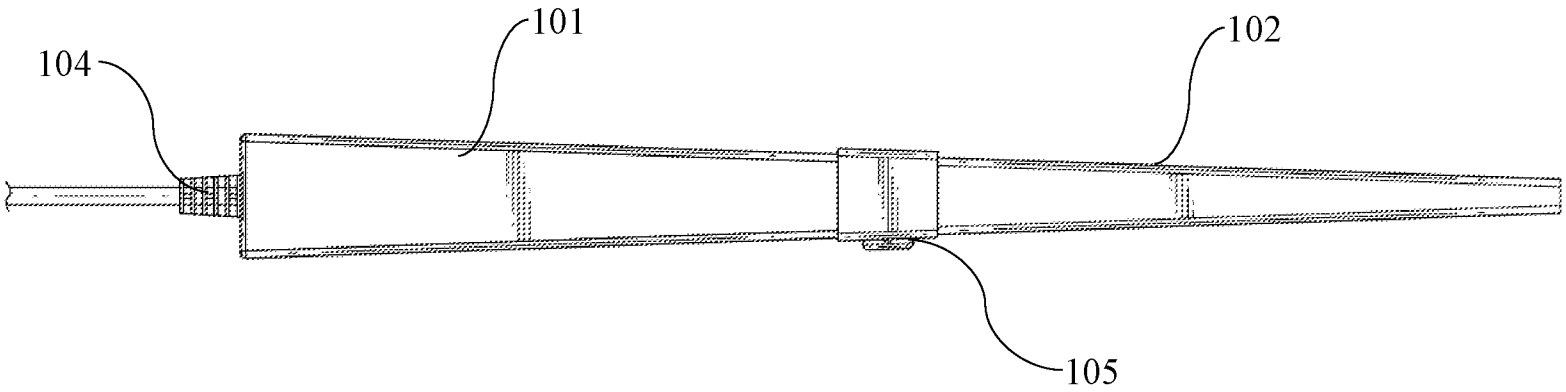
FIG. 5 is a left-side elevational view thereof.
Figure 6:
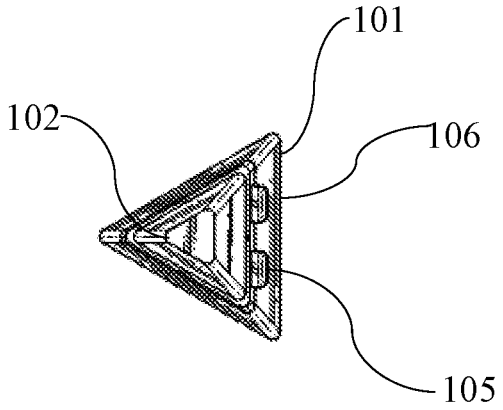
FIG. 6 is a top plan view thereof.
Figure 7:
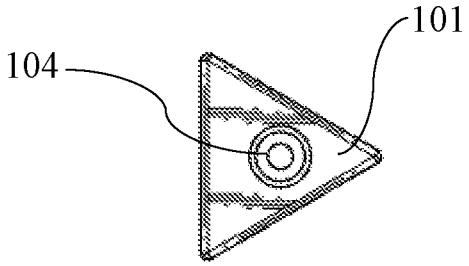
FIG. 7 is a rear plan view thereof.

The invention relates to a triangular curling iron. The invention is described herein.

Referring to the figures there is shown a curling iron 100. Curling iron 100 has a handle 101 for safely manipulating the curling iron, and a triangular iron body 102. The curling iron may have a cool tip provided at a distal end of triangular iron body 102. The cool tip preferably remains substantially cool during heated operation of the curling iron, thereby providing a safe and comfortable location for manipulating the curling iron in addition to handle 101.

Curling iron 100 preferably receives power from an electrical outlet via power cord 104. It should be appreciated that the curling iron may be powered by, for example, a battery or other suitable sources of electrical power.

Handle 101 is preferably thermally insulated from triangular iron body 102 that is heated to style hair. Handle 101 preferably provides a substantial surface that can be grasped and manipulated (e.g., turned) during the styling of hair. Handle 101 may also have a triangular shape, similar to the shape of triangular iron body 102, or it may be a round cylindrical shape. The triangular shape of handle 101 makes it easy to determine the orientation of triangular iron body 102, as the orientation of handle 101 matches the orientation of triangular iron body 102. Handle 101 can have a soft-grip covering and/or other features located in or on the handle to facilitate comfortable and practical manipulation of curling iron 100. Handle 101 may also include a raised hand guard, preventing the fingers from touching triangular iron body 102.

In one embodiment of the present invention, triangular iron body 102 preferably tapers from a proximal end located at or near the handle 101 of the curling to a distal end located at or near the tip. Due to the taper of the triangular iron body 102, the radius (e.g., a first radius) of the triangular iron body 102 at or near the proximal end is greater than the radius (e.g., a second radius) of the triangular iron body 102 at or near the distal end of the triangular iron body 102. Preferably, the transition in the size of the triangular iron body 102's radius is substantially smooth and gradual. The taper of triangular iron body 102 may extend substantially through the entire length of triangular iron body 102, or it may only be for a portion of triangular iron body 102.

In one embodiment of the invention, handle 101 contains switches 105 and 106, which control the heating elements of curling iron 100. These heating elements heat up triangular iron body 102, heating the hair so it may be curled. Heating elements in curling irons are well known to those within the art, and may be a ceramic heater, or other heaters known in the art.

While certain preferred embodiments of the invention have been specifically disclosed, it should be understood that the invention is not limited thereto as many variations will be readily apparent to those skilled in the art and the invention is to be given its broadest possible interpretation within the terms of the following claims. Thus a curling iron has been described.

What is claimed is:

1. A curling iron comprising:

a hair styling iron body;

wherein said hair styling iron body has a triangular shape;

wherein the triangular shape includes a triangular cross-section that tapers from a larger proximal cross-section to a smaller distal cross-section at a tip;

a heating element that heats the hair styling iron body;

a non-heated handle connected to the hair styling iron body; and wherein the non-heated handle and the hair styling iron body are tapered along an entire length of the curling iron from a proximal end of the non-heated handle to a distal end of the hair styling iron body at the tip.

* * * * *